US009334446B2

(12) United States Patent
Cheng et al.

(10) Patent No.: US 9,334,446 B2
(45) Date of Patent: May 10, 2016

(54) THERMAL CRACKER DEVICE

(71) Applicant: E-Sunscience Co., Ltd., Taipei (TW)

(72) Inventors: Li-Feng Cheng, Taipei (TW); Hsien-Cheng Yu, Taipei (TW); Wen Chun Kuo, Tainan (TW)

(73) Assignee: E-Sunscience Co., Ltd., Taipei (TW)

( * ) Notice: Subject to any disclaimer, the term of this patent is extended or adjusted under 35 U.S.C. 154(b) by 457 days.

(21) Appl. No.: 13/909,317

(22) Filed: Jun. 4, 2013

(65) Prior Publication Data

US 2013/0319843 A1 Dec. 5, 2013

Related U.S. Application Data

(60) Provisional application No. 61/655,478, filed on Jun. 4, 2012.

(51) Int. Cl.

| | |
|---|---|
| ***C10B 1/04*** | (2006.01) |
| ***C10B 21/20*** | (2006.01) |
| ***C10B 47/06*** | (2006.01) |
| ***C10B 53/00*** | (2006.01) |

(52) U.S. Cl.
CPC . *C10B 21/20* (2013.01); *C10B 1/04* (2013.01); *C10B 47/06* (2013.01); *C10B 53/00* (2013.01)

(58) Field of Classification Search
CPC ..... C10B 1/04; C10B 47/06; C10B 53/00; C10B 21/20; F23G 5/0273
USPC ..... 202/105, 266, 124, 127, 83, 95, 96, 97, 202/98, 217, 220, 222, 239; 201/10; 422/198, 205; 48/119, 123; 110/242; 432/77, 81
See application file for complete search history.

(56) References Cited

U.S. PATENT DOCUMENTS

| | | | | | |
|---|---|---|---|---|---|
| 835,747 | A * | 11/1906 | Brown | C10B 53/06 | 202/127 |
| 1,418,745 | A * | 6/1922 | Sworski | C10B 1/04 | 202/127 |
| 5,224,432 | A * | 7/1993 | Milsap, III | F23G 5/0273 | 110/229 |
| 7,371,308 | B1 * | 5/2008 | Hackl | C10B 1/04 | 201/25 |
| 7,789,999 | B2 * | 9/2010 | Lee | F23G 5/0273 | 110/242 |

* cited by examiner

*Primary Examiner* — Jill Warden
*Assistant Examiner* — Joye L Woodard
(74) *Attorney, Agent, or Firm* — Leong C. Lei

(57) ABSTRACT

A thermal cracker device includes an outer furnace and a thermal cracking furnace accommodated in the outer furnace. The outer surface of the thermal cracking furnace and the inner surface of the outer furnace define a space. The outer surface of the thermal cracking furnace has a fin structure to define an air flow channel in the space.

6 Claims, 6 Drawing Sheets

THERMAL CRACKER DEVICE

CROSS-REFERENCE TO RELATED APPLICATIONS

This application claims the benefit of the filing date priority of a U.S. Provisional Application No. 61/655,478 filed on Jun. 4, 2012, the disclosure of which is incorporated herein by reference in its entirety.

BACKGROUND

1. Technical Field

The present invention relates to a thermal cracker device, particularly to a device that can make even thermal conduction to obtain uniform temperature during pyrolysis process.

2. Related Art

A common method for processing trash or waste is by means of burying or using incinerator, melting furnace, or thermal cracking furnace. However, in recent years, the trash or waste treatment problem has drawn more and more public attention. By the development of technology, the trash or waste caused negative effect to the environment or with poisonous chemicals, such as huge amount of obsolete tires, if not being well-managed in a proper way, will pollute the natural environment and is seriously harmful to the health of the human beings.

A burning temperature of the incinerator is about 800° C.-900° C., which can burn the trash or waste to ashy condition. A burning temperature of the melting furnace is about 1500° C., which can turn the ashes into melting condition. However, these methods cannot recycle useful materials from the trash or waste, and cannot reduce the processing cost and pollutions as well.

Pyrolysis is a method by heating the trash or waste at about 500° C.-800° C. in a non-oxygen or near non-oxygen environment (by using a vacuum pump) to separate and recycle the organic compound. The temperature needed for the pyrolysis is relatively lower than the incinerator and melting furnace. The pyrolysis products of the obsolete tires mainly include liquid oil, carbon black, steel wire, and some flammable mixed gas containing three-phase products. Thus, using pyrolysis to process the trash or waste can obtain fuels and some useful chemical products. In view of forgoing, pyrolysis is a better way to deal with the trash or waste nowadays, because some useful by-products can be obtained after the procedure.

Improving the temperature control efficiency is the most important part for rising/lowering temperature for the thermal cracking furnace. If the temperature is not correct, the heat flow characteristic will change, which will influence the yield of the pyrolysis. A conventional thermal cracking equipment includes an outer furnace and a thermal cracking furnace. A conventional heat pipe is arranged inside the thermal cracking furnace, and the heat is conducted from the inner to the outside. Even though more or taller heat pipes will improve the heat conduction effect, the volume of the thermal cracking furnace will be influenced as well. Thus, the common heat pipe is usually situated on the middle near the lower part of the thermal cracking equipment, which results in significant temperature differences between the upper part and the lower part of the thermal cracking furnace, and thus forcing the pyrolysis area to be only in the lower part of the thermal cracking furnace. And, since the conventional heat pipe is installed inside the thermal cracking furnace, the heat pipe will become a hindrance for adding a stirring mechanism inside the thermal cracking furnace.

Now the critical issue for the industrial pyrolysis lies in that: how to reach the temperature of the furnace to the final set value. Therefore, it is necessary to have an improved thermal cracking furnace structure to replace the conventional heat pipe heating structure, and further keeping the temperature of the furnace within ±5° C. of the set value to achieve fine tuning function.

BRIEF SUMMARY

The present invention relates to a thermal cracker device with even thermal conduction to obtain uniform temperature during pyrolysis process.

In order to achieve the aforementioned goal, the thermal cracker device according to the present invention includes an outer furnace and a thermal cracking furnace being accommodated in the outer furnace, wherein an outer surface of the thermal cracking furnace is provided with a fin structure, a space is defined between an outer side of the thermal cracking furnace and an inner side of the outer furnace, and an air flow channel is defined in the space by the fin structure.

When using the thermal cracking furnace to do the pyrolysis reaction, the first step is heating the thermal cracking furnace. At this time, the heated air will flow along the fin structure, and the heating for the whole thermal cracking furnace will be in an uniform condition. Compared to the conventional technique, the thermal cracking furnace according to the present invention allows the heated air to flow from a heating hole into a closed space, and the heated air will flow upward along the spiral structure of the exterior wall of the thermal cracking furnace, and finally flow into an exhaust pipe via an exhaust vent installed on the top of the outer furnace. From the flowing path of the aforementioned heated air, we can find that heated air evenly flows in the closed space between the outer furnace and the thermal cracking furnace, and meanwhile, the flowing path distance for the heated air is increased, which means the time that the heated air stays in the furnace is increased as well. By this arrangement, the heating effect of the heated air and the pyrolysis efficiency are improved, and the pyrolysis speed and the yield rate will largely increase also.

The fin structure of the outer side wall of the thermal cracking furnace is thermal electrical couple type fin structure which can conduct the heat. The fin structure can be lateral type, vertical type, or spiral type. The range of the slope of the spiral type fin is ±(0.015 to 0.23). The fin structure can replace the conventional heat pipe heating structure. The fin structure can be added with a thermal electrical couple to detect the temperature, and the detected temperature can be transmitted to short or long distance auto heating control device to keep the temperature within ±5° C. by fine tuning, thereby improving the whole temperature control system of the furnace.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
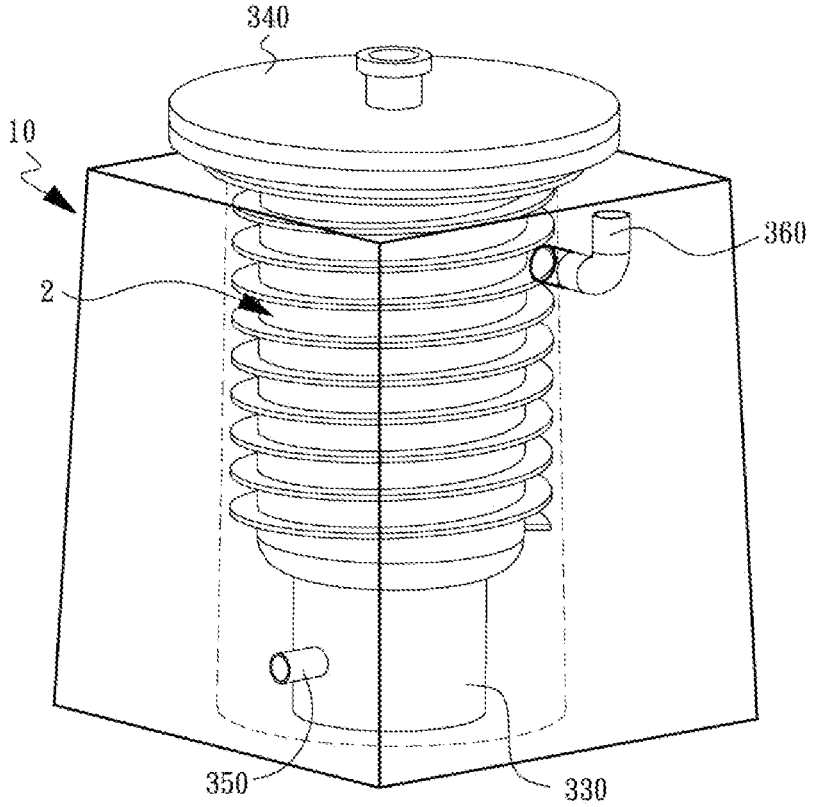
FIG. 1 is an assembling perspective view of a first embodiment of a thermal cracker device according to the present invention.

Referring to FIG. 1, the thermal cracker device mainly includes an outer furnace 10, a thermal cracking furnace 2, a base 330, a top cover 340, a heating hole 350, and an exhaust vent 360. A closed space is provided between the outer furnace 10 and the thermal cracking furnace 2. Heated air enters from the heating hole 350 and flows upward along an outer surface of the thermal cracking furnace 2 in the closed space. The heated air uniformly heats the thermal cracking furnace 2, and an exhaust gas finally flows into a waste heat pipe via the exhaust vent 360.

Figure 2:
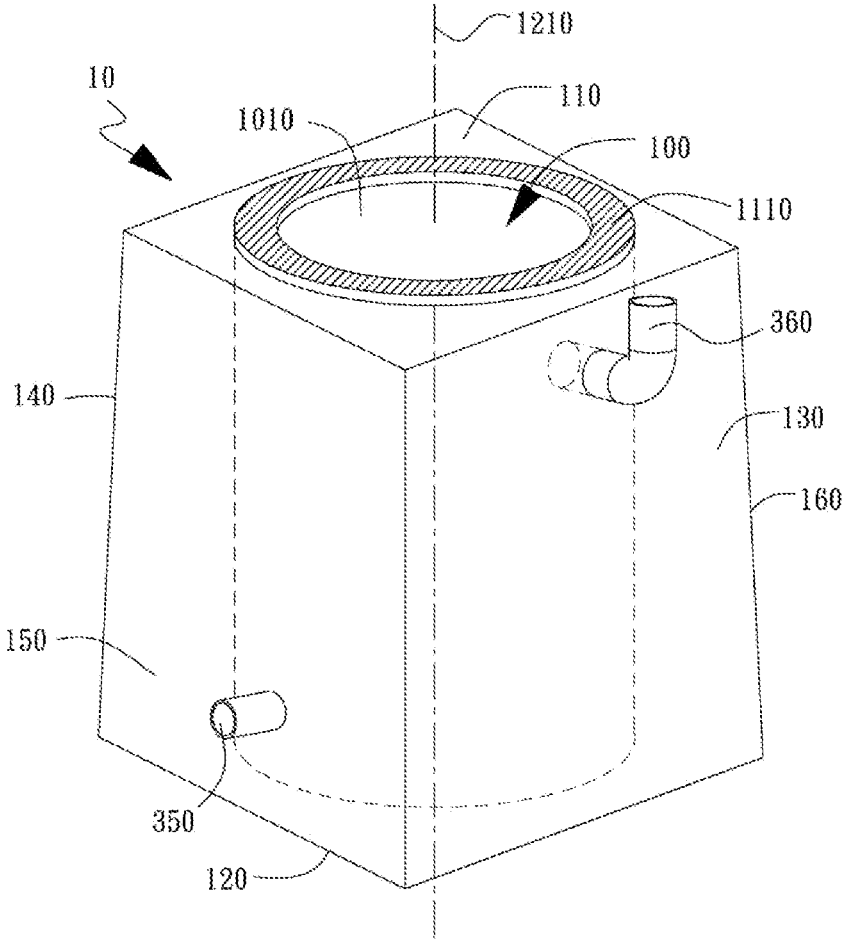
FIG. 2 is a schematic diagram of the first embodiment of an outer furnace according to the present invention.

As shown in FIG. 2, the outer furnace 10 is a hollow cube, which includes a top portion 110, a bottom portion 120, a front side wall 130, a back side wall 140, a left side wall 150, and a right side wall 160. The outer furnace 10 has a metal material case with a hollow chamber 100 for accommodating the thermal cracking furnace 2. The heating hole 350 is provided on a lower part of the left side wall 150, and an exhaust vent 360 is provided on an upper part of the front side wall 130. An installation port 1010 is provided on the top portion 110 of the outer furnace 10, and the installation port 1010 connects to the hollow chamber 100 to allow the thermal cracking furnace 2 to be installed into the outer furnace 10. In the present embodiment, the outer furnace 10 is a hollow cube, but not limited thereto. The positions of the heating hole 350 and the exhaust vent 360 are not limited to the left side wall 150 and the front side wall 130, respectively. Any similar structure with the same invention spirit will be the same as the present invention.

Figure 3:
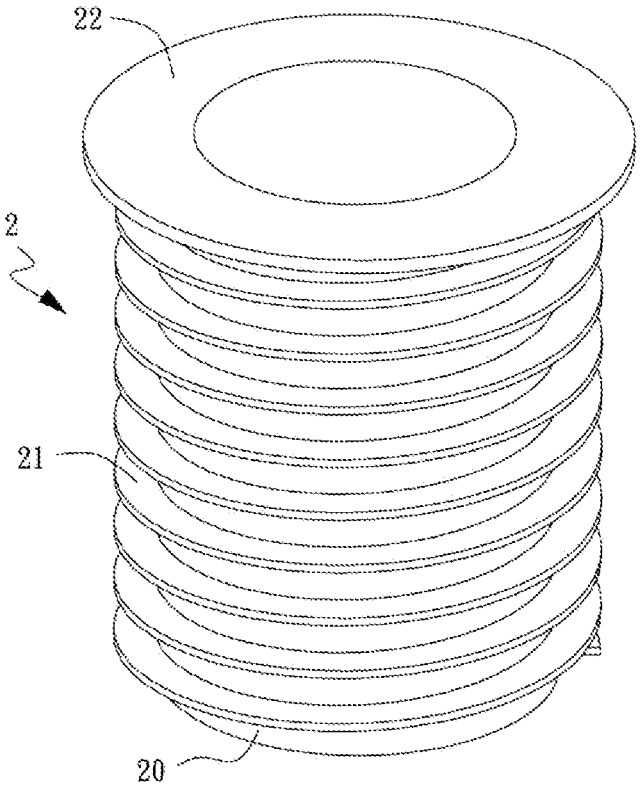
FIG. 3 is a schematic diagram of the first embodiment of a thermal cracking furnace according to the present invention.

The aforementioned outer furnace 10 has an insulating and cooling function. An inner surface of the outer furnace 10 is covered with a layer of insulating material 1110 to seal the heat inside the whole furnace system. As shown in FIG. 3, the thermal cracking furnace 2 has a main body 20 approximately formed in tubular shape, but not limited thereto. The main body 20 can also be formed in other shapes, as long as the main body 20 can be accommodated into the hollow chamber 100 of the outer furnace 10, and a space will exist between the main body 20 and the outer furnace 10. An outer surface of the main body 20 is provided with a spiral shape fin structure 21. However, the fin structure 21 is not limited to spiral shape. In other embodiments, the fin structure 21 can also be formed in lateral type or vertical type. When the thermal cracking furnace 2 is assembled into an outer furnace 1, a head portion 22 is in contact with the top portion 110, and being covered with the top cover 340. By this arrangement, a closed space will be formed between the thermal cracking furnace 2 and the outer furnace 10. The other end opposite to the head portion 220 contacts the base 330 which is near the bottom side 120 of the outer furnace 10. The base 330 is preferably a firebrick.

When using the thermal cracking furnace 2 to do the pyrolysis reaction, the first step is heating the thermal cracking furnace 2. At this time, the heated air will flow along the fin structure 21, and the heating for the whole thermal cracking furnace will be in a uniform condition. The heating hole 350 used for heating the thermal cracking furnace 2 is provided near the lower part of the left side wall 150 of the outer furnace 10. The heating hole 350 connects the hollow chamber 100. The exhaust vent 360 is provided on the upper part of the front side wall 130 of the outer furnace 10. The exhaust vent 360 connects the hollow chamber 100 to exhaust waste gases generated during the heating process. When the heated air enters from the heating hole 350 into the closed space, the heated air will flow upward along the spiral fin structure 21 of the exterior wall of the thermal cracking furnace 2, and finally flowing into an exhaust pipe via the exhaust vent 360 installed on the top of the outer furnace 10. From the flowing path of the aforementioned heated air, we can find that heated air evenly flows in the closed space between the outer furnace 10 and the thermal cracking furnace 2, and meanwhile, the flowing path distance for the heated air is increased, which means the time that the heated air stays in the furnace is increased as well. By this arrangement, the heating effect of the heated air and the pyrolysis efficiency are improved, and the pyrolysis speed and the yielding rate will largely increase as well.

Improving the temperature control efficiency is the most important part for rising/lowering temperature for the thermal cracking furnace. If the temperature is not correct, the heat flow characteristic will change, which will influence the yield of the pyrolysis. The spiral shape fin structure 21 in the present embodiment is consisted of thermal electric couple type fins, and the thermal electric couple type fin structure 21 can replace the conventional heat pipe structure. The fin structure 21 added with a thermal electrical couple can detect the temperature, and the detected temperature can be transmitted to short or long distance auto heating control device to keep the temperature within ±5° C. by fine tuning, thereby improving the whole temperature control system of the furnace. The whole fin structure 21 can be seen as a heat conductor, which keeps the whole thermal cracking furnace 2 under uniform temperature, and the heat conduction for the whole pyrolysis process will be uniform as well. In brief, the main purpose of the fin structure 21 is to make sure the temperature of the thermal cracking furnace 2 can reach to the final set value.

Because of the material characteristic of the outer furnace 10, which has an ability of heat preservation, the inner temperature of the whole thermal cracking furnace 2 can be kept in a specific working temperature. One of the features according to the present invention is that the quick and even temperature rising of the thermal cracking furnace 2 can be achieved by installing the spiral shape fin structure 21, and the conventional technique that uses a heating convex pillar which protrudes from the bottom of the thermal cracking furnace is no longer needed, and thus preventing the waste of room spaces. Moreover, the thermal cracking furnace 2 with the fin structure 21 can also be installed a stirring mechanism inside the thermal cracking furnace 2 if needed.

Figure 4:
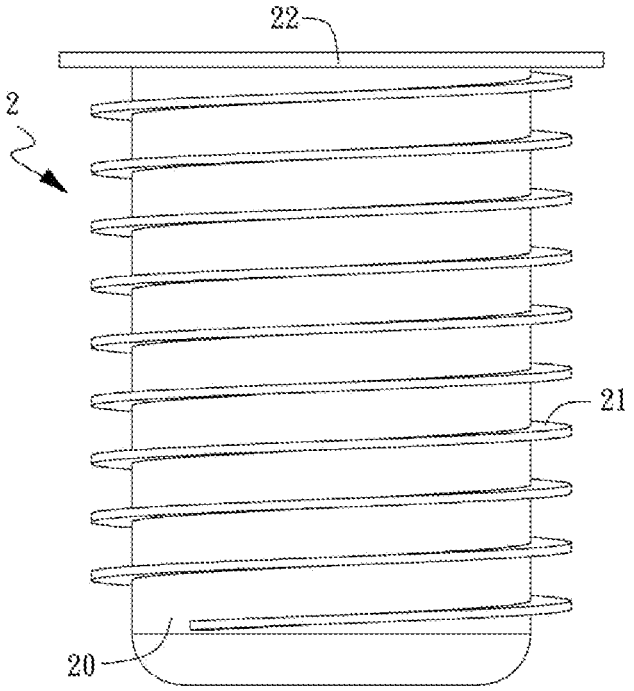
FIG. 4 is a side view of the first embodiment of the thermal cracking furnace according to the present invention.

Please refer to FIG. 4, it is clear to see the looks of the fin structure 21 of the thermal cracking furnace 2. The fin structure 21 can be a spiral structure gyrates from lower left to the upper right, or from lower right to the upper left. The slope range of the spiral shape fin structure 21 is ±(0.015 to 0.23), and the fin structure 21 can replace the conventional heat pipe structure.

In the present embodiment, the whole fin structure 21 has the same slope. However, in other embodiments, the fin structure 21 can also be designed to have at least two segments with different slopes. A width of the wall of the thermal cracking furnace 2 is about 0.3 cm to 4 cm, and the ratio of the width of the wall of the thermal cracking furnace 2 to a width of the fin structure 21 is 1:2 to 1:128, preferably is 1:32. A spiral flowing channel can be formed between the spiral shape fin structure 21 and the interior wall of the outer furnace 10. The heated air can be heated by the heating hole 350 in a lower place, and then steadily flows upward along the spiral flowing channel, and finally being exhausted from the exhaust vent 360 located on an upper place. Even more, a heating coil can be installed on the fin structure 21, and use fin structure 21 to increase the heat conduction area, thereby making even heat conduction to keep the temperature of the thermal cracking furnace 2 in a uniform condition, and thus increasing the pyrolysis reaction area.

Figure 5:
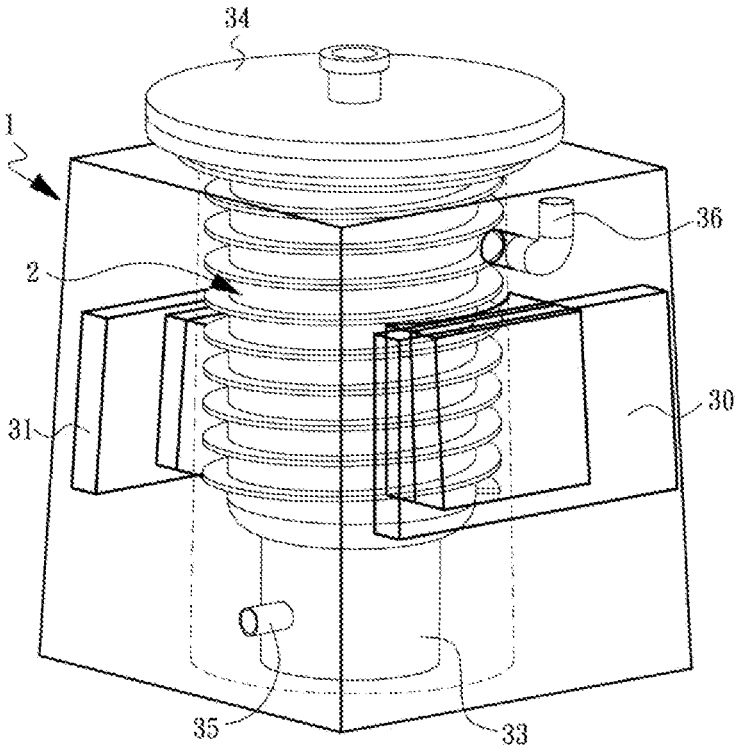
FIG. 5 is an assembling perspective view of a second embodiment of the thermal cracker device according to the present invention.

The conventional heat pipe is arranged inside the thermal cracking furnace 2, and the heat is conducted from the inner to the outside. Even though more or taller heat pipes will improve the heat conduction effect, the volume of the thermal cracking furnace 2 will be influenced as well. Thus, the common heat pipe is usually situated on the middle near the lower part of the thermal cracker furnace 2, which results in significant temperature differences between the upper part and the lower part of the thermal cracking furnace 2, and thus forcing the pyrolysis area to be only in the lower part of the thermal cracking furnace. And, since the conventional heat pipe is installed inside the thermal cracking furnace 2, the heat pipe will become a hindrance for adding a stirring mechanism inside the thermal cracking furnace 2. Therefore, after replacing the conventional heat pipe with the fin structure 21, the thermal cracking furnace 2 can be heated more evenly, and can selectively add a stirring function to improve the whole pyrolysis efficiency. The fin structure 21 is a thermal electrical couple temperature detector. When two terminals of two different kinds of metals are connected to form a closed loop, electricity will be generated once there is a temperature difference between the two terminals. By using the amplifier to amplify the electricity signal, the detected temperature can be observed from the monitor Please refer to FIG. 5, the thermal cracker device mainly includes an outer furnace 1, a thermal cracking furnace 2, a first adiabatic cover 30, a second adiabatic cover 31, a base 33, a top cover 34, a heating hole 35, and an exhaust vent 36. A closed space is provided between the outer furnace 1 and the thermal cracking furnace 2. Heated air enters from the heating hole 35 and flows upward along an outer surface of the thermal cracking furnace 2 in the closed space. The heated air uniformly heats the thermal cracking furnace 2, and an exhaust gas finally flows into a waste heat pipe via the exhaust vent 36.

Figure 6:
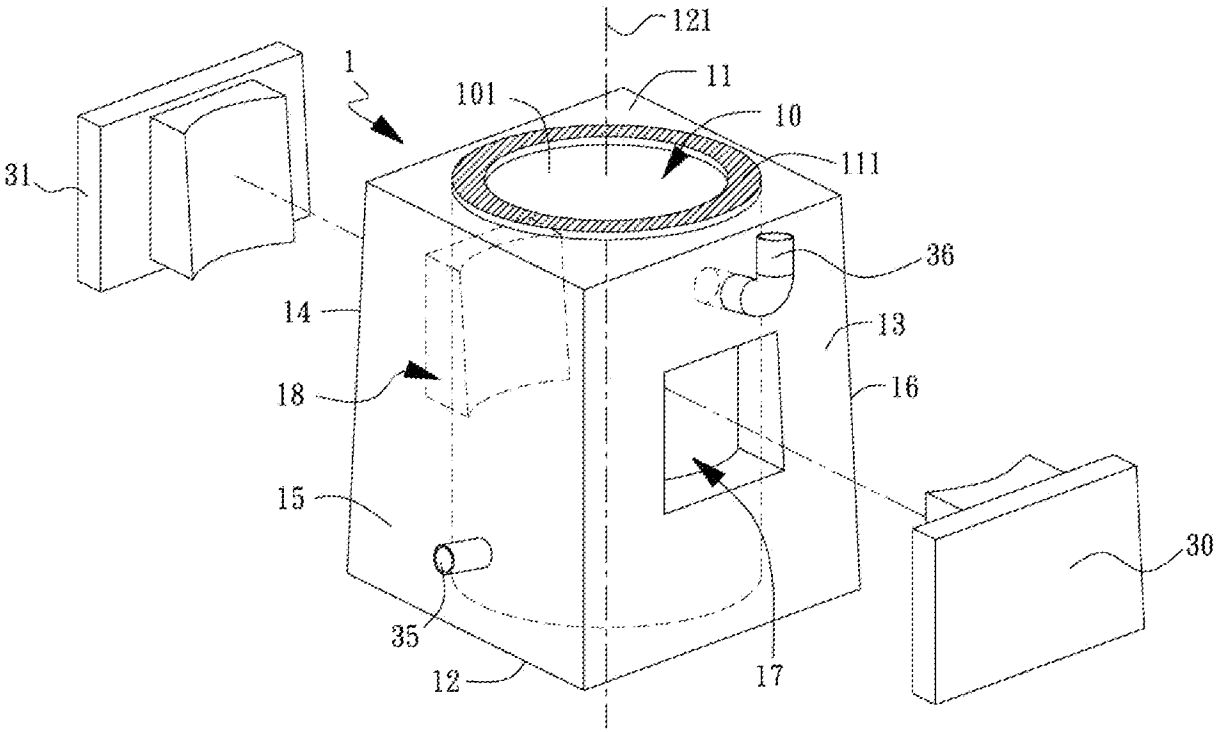
FIG. 6 is an exploded view of the second embodiment of the outer furnace according to the present invention.

As shown in FIG. 6, the outer furnace 1 is a hollow cube, which includes a top portion 11, a bottom portion 12, a front side wall 13, a back side wall 14, a left side wall 15, and a right side wall 16. The outer furnace 1 has a metal material case with a hollow chamber 10 for accommodating the thermal cracking furnace 2. The heating hole 35 is provided on a lower part of the left side wall 15, and an exhaust vent 36 is provided on an upper part of the front side wall 13. An installation port 101 is provided on the top portion 11 of the outer furnace 1, and the installation port 101 connects to the hollow chamber 10 to allow the thermal cracking furnace 2 to be installed into the outer furnace 1. In the present embodiment, the outer furnace 1 is a hollow cube, but not limited thereto. The positions of the heating hole 35 and the exhaust vent 36 are not limited to the left side wall 15 and the front side wall 13, respectively. Any similar structure with the same invention spirit will be the same as the present invention.

In the present embodiment, the front side wall 13 and the back side wall 14 which are located on the opposite side of the outer furnace 1 are provided with a first cooling opening 17 and a second cooling opening 18, and the first cooling opening 17 and the second cooling opening 18 directly penetrate the outer furnace 1 and further connect to the hollow chamber 10. In the present embodiment, the first cooling opening 17 and the second cooling opening 18 are approximately located on the same height, which is along the direction of the central axis 121.

When the garbage pyrolysis process is completed, the first cooling opening 17 and the second cooling opening 18 can be opened by removing the first adiabatic cover 30 and the second adiabatic cover 31 from the corresponding openings. By doing so, the outer air can flow into one of the cooling openings 17 or 18 and flows out from the other cooling openings 17 or 18. Such configuration can minimize the turbulence and increase the air flowing speed to quickly cool down the thermal cracking furnace 2. On the other hand, during the period that the air flows in and out of the outer furnace 1, the air is forced to flow through the thermal cracking furnace 2 with the spiral shape fin structure 21, thereby making the cooling rate of the thermal cracking furnace 2 faster than the conventional design.

In other embodiments, the first cooling opening 17 and the second cooling opening 18 can be designed to have different heights along the direction of a central axis 121 of the outer furnace 1. The position of the first cooling opening 17 is higher than the second cooling opening 18 along the axial direction. The advantage of this arrangement lies in that, cool air flows into the second cooling opening 18 and is heated in a closed space, and then the heated air flows upward to the outside from the first cooling opening 17. To cooperate with the fin structure 21 of the thermal cracking furnace 1, a very fast cooling speed can be achieved.

The present invention would be more valuable if being used in mobile pyrolysis system. By using the limited space in a container car, a whole pyrolysis system including the equipment for pyrolysis process, condensation, feeding, oil storage, waste air processing, electricity generation, and carbon black recycle can be achieved. Since the storage space of the container car is very limited, a larger insulating and cooling cracking device which can process large amount of garbage cannot be accommodated in the vehicle, and thus a high efficiency thermal cracker device with a fin structure is necessary. The thermal cracker device according to the present invention uses low temperature pyrolysis technique to prevent high temperature which might damage the steel structure of the container car. The mobile pyrolysis system can directly move to the raw material area to process the garbage, and turn the pyrolysis product into electricity. Moreover, when the container car moves to next places, the thermal cracker device can also utilize the flowing air generated by the moving vehicle to cool down the thermal cracking furnace 2, thereby saving precious time.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A thermal cracker device, comprising:

an outer furnace; and a thermal cracking furnace being accommodated in the outer furnace;

wherein an outer surface of the thermal cracking furnace is provided with a fin structure, a space is defined between an outer side of the thermal cracking furnace and an inner side of the outer furnace, an air flow channel is defined in the space by the fin structure, wherein a ratio of a wall thickness of the thermal cracking furnace to a width of the fin structure is 1:2 to 1:128.

2. The thermal cracker device according to claim 1, wherein the fin structure is formed as spiral shape.

3. The thermal cracker device according to claim 2, wherein a slope of the fin structure is between ±(0.015 to 0.23).

4. The thermal cracker device according to claim 1, wherein the outer furnace has at least one cooling opening.

5. The thermal cracker device according to claim 4, wherein the outer furnace has a first cooling opening and a second cooling opening, the first cooling opening and the second cooling opening are situated on two opposite side walls.

6. The thermal cracker device according to claim 5, wherein the first cooling opening faces directly opposite to the second cooling opening.

* * * * *